United States Patent [19]

Tervamäki

[11] 4,284,604

[45] Aug. 18, 1981

[54] PIPETTE WITH ADJUSTABLE VOLUME

[75] Inventor: Jukka Tervamäki, Helsinki, Finland

[73] Assignee: Kommandiittiyhio Finnpipette Osmo A Suovaniemi, Helsinki, Finland

[21] Appl. No.: 44,155

[22] Filed: May 31, 1979

[30] Foreign Application Priority Data

Jun. 2, 1978 [FI] Finland ..... 781764

[51] Int. Cl.[3] ..... B03C 1/00; B01L 3/02

[52] U.S. Cl. ..... 422/100; 73/864.18; 128/218 P; 128/218 C

[58] Field of Search ..... 73/425.6, 425.4 P; 141/27; 222/44, 47, 49, 50, 309; 128/218 R, 218 F, 218 C, 218 P, 218 PA; 422/100

[56] References Cited

U.S. PATENT DOCUMENTS

| | | | |
|---|---|---|---|
| 2,771,277 | 11/1956 | Brown et al. | 422/100 |
| 2,792,834 | 5/1957 | Kapelsohn | 128/218F |
| 3,327,904 | 6/1967 | Goda et al. | 222/309 |
| 3,780,734 | 12/1973 | Wulff | 128/218 P |
| 3,834,590 | 9/1974 | Robinson et al. | 73/425.6 |
| 4,096,750 | 6/1978 | Sturm | 73/425.6 |
| 4,141,251 | 2/1979 | Oshikubo | 73/425.6 |

FOREIGN PATENT DOCUMENTS

| | | |
|---|---|---|
| 1952774 | 7/1970 | Fed. Rep. of Germany . |
| 866795 | 5/1961 | United Kingdom . |
| 950992 | 3/1964 | United Kingdom . |
| 1439659 | 6/1976 | United Kingdom . |
| 1528105 | 10/1978 | United Kingdom . |

*Primary Examiner*—William F. Smith
*Assistant Examiner*—Chris Konkol
*Attorney, Agent, or Firm*—Hopgood, Calimafde, Kalil, Blaustein & Lieberman

[57] ABSTRACT

The subject of the invention is a pipette with an adjustable volume, wherein an upper stop bushing provided with inside threading is arranged around the piston shaft of the pipette in corresponding threading formed around said piston shaft. When the press button is turned, the upper stop bushing that determines the top position of the piston can be moved by means of the thread joint up and down in relation to the piston shaft so as to adjust the volume of the pipette. In the frame casing of the pipette, along the side, a longitudinal slit passing through the frame casing and provided with a scale is arranged. At the bottom end of the piston shaft, an expansion part is arranged or formed into which a ball is fitted in a bore,, said ball being pressed outwards by a spring. When the press button is turned, the ball is always during the movement of rotation, when it comes over the slit in the pipette frame, pressed against the sides of the slit in the wall of the upper stop bushing thereby locking the press button and the piston shaft in position. Then, by means of its position in the slit, the ball expresses the pipettable volume, which can be read from the scale.

4 Claims, 4 Drawing Figures a–a. I.

PIPETTE WITH ADJUSTABLE VOLUME

The subject of the present invention is a pipette with an adjustable volume, said pipette comprising a frame that constitutes the handle portion, the cylinder part with the tip tubes being connected to the bottom end of said handle portion, a piston fitted into the cylinder part, which piston can be pressed against the spring force of a spring by means of a press button and a piston shaft downwards and which piston is arranged so that the spring restores it to the upper position and wherein an upper stop bushing provided with inside threading is arranged in the corresponding threading formed around the piston shaft of the pipette, the upper position of the piston being arranged as determined by means of said upper stop bushing, and wherein the upper stop bushing and the pipette frame are provided with jointly operative means, such as a groove-projection arrangement, which prevent their becoming turned in relation to each other but, however, permit movement of the upper stop bushing in relation to the frame in the direction of the piston shaft, whereby, when the press button is turned, the upper stop bushing, which determines the top position of the piston, can be moved by means of the threaded joint up and down in relation to the piston shaft so as to adjust the pipette volume.

The object of the present invention is to provide a periodically or stepwise adjustable pipette of maximum simplicity but, nevertheless, of reliable operation and of precise adjustment, which pipette may be either a single-tip or single-channel pipette or a multi-tip or multi-channel pipette, i.e. a so-called series pipette.

The pipette in accordance with the invention is mainly characterized in that in the frame casing of the pipette along the side a longitudinal slit passing through the frame casing and provided with a scale is arranged and that at the bottom end of the piston shaft an expansion part is arranged or formed into which, in a bore, a ball is fitted that is pressed outwards by a spring or that in the cylindrical outer face of the expansion part a resiliently yielding bulging or nodule is arranged as producing the corresponding function, so that, when the press button is turned, the ball or the corresponding means is always during the rotation movement, when it comes over the slit in the pipette frame, pressed against the sides of the groove or slit in the upper stop bushing thereby locking the press button and the piston shaft in position, and whereby the ball or the corresponding means or a marking point or marking line placed on the outer face of the upper stop on the slit, by means of its position in the slit, indicates the periodically or stepwise adjustable volume to be pipetted, which can be read from the scale.

Figure 1:
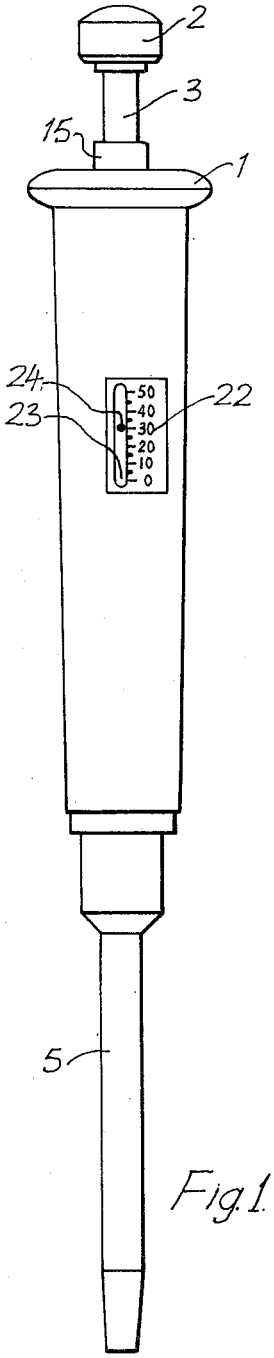
Figure 2:
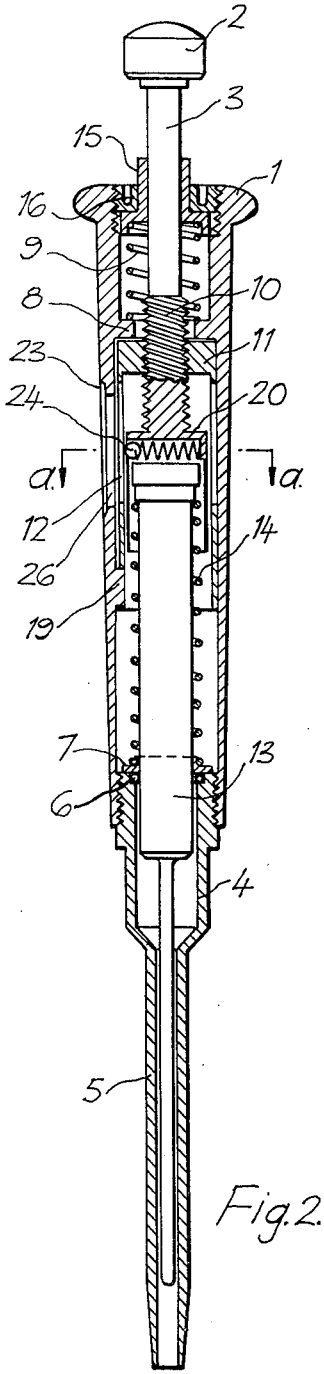
Figure 3:
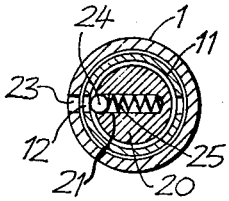
Figure 4:
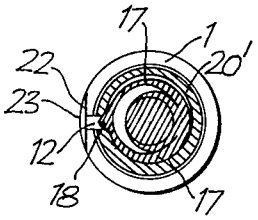

The invention comes out more closely from the following description and from the attached drawing, wherein FIG. 1 shows the pipette as a side view, FIG. 2 shows the pipette of FIG. 1 as a side view in section, FIG. 3 shows a section along line a-a in FIG. 2, and FIG. 4 shows a construction embodiment alternative to the embodiment shown in the sectional view in FIG. 3.

FIG. 2 discloses a pipette whose volume is adjustable and which comprises a frame 1 forming the handle portion, at the bottom end of which frame is by means of threading attached a cylinder part 4 with tip tube 5.

The bottom end of the tip tube 5 is designed so that a disposable tip vessel (not shown in the drawing) can be attached to it, into which tip vessel the liquid to be pipetted is supposed to be sucked. Into the cylinder part 4 a piston 13 is fitted, and around the piston 13 a coil spring 14, which presses the piston 13 upwards. At the upper end of the cylinder part 4 there is a ring groove, into which a seal ring 6 is fitted around the piston 13. The seal ring 6 is closed into the groove by a ring disk 7 pressed down by the bottom end of the spring 14. A piston shaft 3 is arranged as affecting the upper end of the piston 13, the upper end of said shaft being provided with a press button 2. Inside the pipette frame 1 there is an annular shoulder 8, against which a secondary spring 9 fitted around the piston shaft 3 rests. At the upper end of the pipette frame 1, a glide bushing 15 is fitted by means of a calibration nut 16, the upper end of the secondary spring 9 resting against the bottom face of said bushing.

In the way coming out from FIG. 2, an upper stop bushing 11 provided with inside threading is fitted into corresponding threading 10 formed around the piston shaft of the pipette, which stop bushing rests against the lower face of the annular shoulder 8 when the piston shaft 3 and the piston 13 are in their upper positions, whereby the upper stop bushing 11 thereby determines the upper position of the piston 13. In order that the upper stop bushing 11 should not be able to rotate inside the pipette frame 1, the outer circumference of the upper stop bushing 11 is provided with a vertical groove 12 into which a vertical projection or wedge 19 in the pipette frame 1 fits. Of course, the groove/wedge arrangement may also be the other way round, i.e. the groove 12 in the frame 1 and the wedge 19 correspondingly in the upper stop bushing 11.

The shaft 3 of the press button 2 ends at the bottom end with a widening or an expansion part 20, ball 24 being fitted into a recess or bore 21 prepared in said widening or expansion part, which ball is pressed outwards by a spring 25. In the frame casing 1 of the pipette, on the side, a longitudinal groove or slit 26 passing through the frame casing 1 and provided with a scale 22 is formed, the outside of which slit is covered with a window 23. When the press button 2 is turned, the expansion part 20 is turned together with the button and the piston shaft 3, and the ball 24 is shifted periodically onto the groove 26 or grooves and is pressed against the sides of the groove 26 thereby locking the shaft 3 of the press button 2 in position in the direction of turning. The locking is opened by turning the press button 2 with somewhat more strength in either one of the directions.

Instead of a coil spring 25 and a ball 24, the expansion part 20 may, of course, be provided with any other structural embodiment that provides the same function, such as an embodiment coming out from FIG. 4, wherein the expansion part 20' is shaped so that it forms leaf-shaped spring means 17 and a projection or nodule 18 fitted to same and replacing the ball. By means of its position in the groove or slit, the ball 24 or the corresponding means, such as the projectiion 18, indicates the pipettable volume, which can be read from the scale 22 and which is periodically or stepwise adjustable.

On the other hand, the outer surface of the upper stop bushing 11 may be provided with a marking point or marking line, which is shifted in the window 23 along the scale 22 when the press button 2 is being turned.

Then the groove 12 in the bushing does not coincide with the groove 26 in the scale.

When the press button 2 is turned, it moves up or down in relation to the upper stop bushing 11 correspondingly shifting the piston 13, which is pressed by the spring 14 against the expansion 20 in the shaft 3 of the button 2. In this way the stroke length of the piston 13 is either increased or decreased.

When pipetting is performed, the button 2 is pressed, whereby, together with the button, the upper stop bushing 11 and the piston 13 move down until the button 2 is pressed against the secondary support 15. For here it is possible to press the button and the piston further down the length of the secondary support 15 extending from the end of the frame 1. An upper stop for the movement of the piston 13 consists of the shoulder 8 in the frame 1, against which the upper stop bushing 11 is pressed when the piston 13 is restored to its upper position.

What we claim is:

1. An adjustable pipette comprising:

a tubular frame including an elongated slot therein said slot being disposed along the longitudinal axis of said frame, said frame including an opening at its upper end;

a tip releaseably connected to the lower end of said frame;

a piston slidably reciprocable in said frame;

a tubular sleeve slidablly and non-rotatably disposed in said frame, said sleeve including an elongated slot aligned with said elongated slot in said frame;

a bushing disposed within said sleeve, said bushing including a threaded opening;

an adjustment rod slidably mounted in the upper portion of said frame and coupled for movement with said piston, the upper end of said adjustment rod extending through the opening at the upper end of said frame and having means to permit manual actuation thereof; the lower end of said adjustment rod including threading engageable with said threading in said bushing; and an extension disposed at the end of said threaded portion of said rod, said extending being disposed within said sleeve, said extension including indicator means and means for biasing said indicator means into said slot in said sleeve to thereby provide a visual indication of the relative position of said actuation rod and said sleeve and thus the volume of fluid to be drawn into said pipette, as well as to provide resistance to the turning of said adjustment rod with respect to said sleeve.

2. A pipette as claimed in claim 1, wherein said indicator means includes a ball and said means for biasing said indicator includes a coil spring.

3. The pipette as claimed in claim 1, wherein said indicator means includes a protrusion and said means for biasing said indicator means includes a leaf spring coupled to said protrusion.

4. The pipette as claimed in claim 1, wherein said frame includes indicia disposed along said elongated slot for indicating the volume to be drawn into said pipette in conjunction with said indicator means.

* * * * *